US009278572B2

(12) United States Patent
Kamins et al.

(10) Patent No.: US 9,278,572 B2
(45) Date of Patent: Mar. 8, 2016

(54) MELTED CRAYON PAINTING SYSTEM

(71) Applicant: FPC Corporation, Grayslake, IL (US)

(72) Inventors: Michael B. Kamins, Wauconda, IL (US); Sandra L. Palmer, Wauconda, IL (US)

(73) Assignee: FPC Corporation, Grayslake, IL (US)

( * ) Notice: Subject to any disclaimer, the term of this patent is extended or adjusted under 35 U.S.C. 154(b) by 225 days.

(21) Appl. No.: 14/253,050

(22) Filed: Apr. 15, 2014

(65) Prior Publication Data

US 2015/0293452 A1 Oct. 15, 2015

(51) Int. Cl.

| | |
|---|---|
| ***B05C 17/005*** | (2006.01) |
| ***B43K 19/00*** | (2006.01) |
| ***B44D 3/00*** | (2006.01) |
| ***B44D 3/22*** | (2006.01) |

(52) U.S. Cl.

CPC ..... *B43K 19/00* (2013.01); *B05C 17/00523* (2013.01); *B05C 17/00526* (2013.01); *B44D 3/00* (2013.01); *B44D 3/22* (2013.01)

(58) Field of Classification Search

None

See application file for complete search history.

(56) References Cited

U.S. PATENT DOCUMENTS

| | | | | |
|---|---|---|---|---|
| 4,279,674 | A | 7/1981 | Wadden | |
| 4,523,705 | A | 6/1985 | Belanger | |
| 4,584,042 | A | 4/1986 | Wandroik | |
| 5,881,912 | A | 3/1999 | Bokros | |
| 6,840,403 | B2 | 1/2005 | Girouard | |
| 2004/0108335 | A1 * | 6/2004 | Girouard | B44D 3/22 222/146.5 |
| 2005/0223929 | A1 | 10/2005 | Frank | |

OTHER PUBLICATIONS

Hoffer, "Melted Crayon Art", Simply Rebekah, (Jul. 29, 2012), <http://simplyrebekah.com/2012/07/29/melted-crayon-art/>.*
http://www.wikihow.com/Make-Melted-Crayon-Art; How to Make Melted Crayon Art Article by WikiHow.

* cited by examiner

*Primary Examiner* — Lisha Jiang
(74) *Attorney, Agent, or Firm* — Neustel Law Offices; Michael Neustel

(57) ABSTRACT

A melted crayon painting system for effectively painting with melted crayon. The melted crayon painting system generally includes providing a tube having a distal end, a receiver-dispenser opening within the distal end and a lumen fluidly connected to the receiver-dispenser opening, heating the tube to a temperature of at least 120 degrees Fahrenheit, inserting the distal end of the tube into a crayon, melting a portion of the crayon with the tube, receiving a volume of melted crayon from the crayon into the lumen from the receiver-dispenser opening, removing the distal end of the tube from the crayon, and dispensing the volume of melted crayon within the lumen from the receiver-dispenser opening.

20 Claims, 13 Drawing Sheets

MELTED CRAYON PAINTING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a crayon melting system and more specifically it relates to a melted crayon painting system for effectively painting with melted crayon.

2. Description of the Related Art

Any discussion of the related art throughout the specification should in no way be considered as an admission that such related art is widely known or forms part of common general knowledge in the field.

Melted crayon art is becoming popular with artists. Melted crayon art is created by melting one or more crayons onto a painting surface. There are two conventional ways to melt crayon: blow dryer or glue guns.

The first method of melting crayons for melted crayon art is by positioning the crayons on the painting surface with the painting surface positioned at an angle and then heating the crayons to their melting point with a blow dryer or hair dryer allowing the melted crayon to flow downwardly along the painting surface. The main problem with using a blow dryer to melt the crayons is that it is difficult to do detailed painting.

The second method of melting crayons for melted crayon art is by inserting a crayon into a rear opening of a glue gun, heating the crayon within the glue gun and then dispensing out the nozzle of the glue gun onto the painting surface. One problem with using glue guns for melted crayon art is that it is difficult to change from a first color of crayon to a second color of crayon because the user has to empty out the glue gun melt body first prior to inserting the second color of crayon. Another problem is that glue guns are not designed for detailed painting since they are designed for melting a thermoplastic adhesive that is dispensed in a thick strip for securing objects together.

Because of the inherent problems with the related art, there is a need for a new and improved melted crayon painting system for effectively painting with melted crayon.

BRIEF SUMMARY OF THE INVENTION

The invention generally relates to a crayon painting system which includes providing a tube having a distal end, a receiver-dispenser opening within the distal end and a lumen fluidly connected to the receiver-dispenser opening, heating the tube to a temperature of at least 120 degrees Fahrenheit, inserting the distal end of the tube into a crayon, melting a portion of the crayon with the tube, receiving a volume of melted crayon from the crayon into the lumen from the receiver-dispenser opening, removing the distal end of the tube from the crayon, and dispensing the volume of melted crayon within the lumen from the receiver-dispenser opening.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
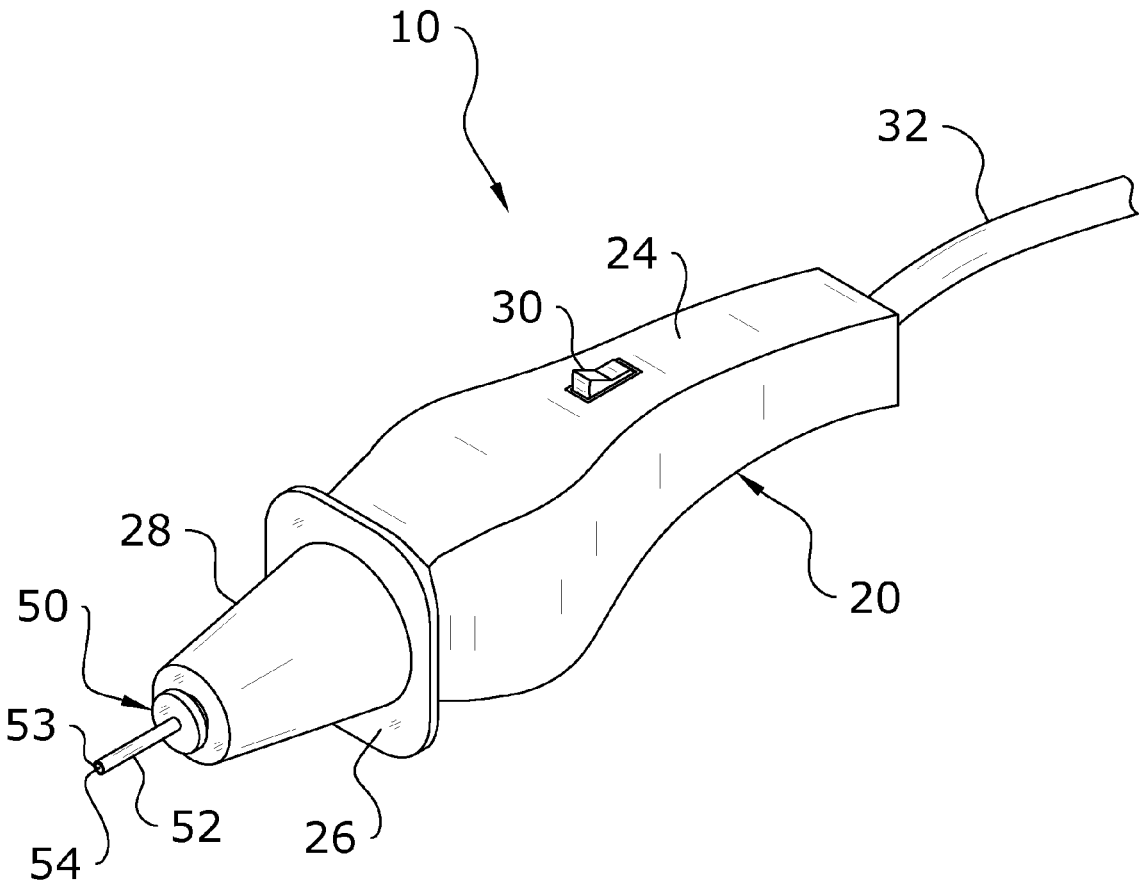
FIG. 1 is an upper perspective view of the present invention.

A. Overview.

Turning now descriptively to the drawings, in which similar reference characters denote similar elements throughout the several views, FIGS. 1 through 9 illustrate a melted crayon painting system 10 for creating melted crayon art, which comprises providing a tube 52 having a distal end 53, a receiver-dispenser opening 54 within the distal end 53 and a lumen 56 fluidly connected to the receiver-dispenser opening 54, heating the tube 52 to a temperature of at least 120 degrees Fahrenheit, inserting the distal end 53 of the tube 52 into a crayon 14, melting a portion of the crayon 14 with the tube 52, receiving a volume of melted crayon 14 from the crayon 14 into the lumen 56 from the receiver-dispenser opening 54, removing the distal end 53 of the tube 52 from the crayon 14, and dispensing the volume of melted crayon 14 within the lumen 56 from the receiver-dispenser opening 54.

B. Crayon.

The crayon 14 may be comprised of any volume of colored wax or other colored material capable of being melted. It is preferred that the crayon 14 be comprised of a standard wax crayon 14 (e.g. petroleum paraffin wax). The crayon 14 may be comprised of a various colors such as but not limited to blue, green, yellow, black and the like. Conventional wax crayons 14 begin to soften around 105 degrees Fahrenheit and have a melting point of about 120 degrees to 147 degrees Fahrenheit.

The crayon 14 may be constructed of various types of structures (e.g. blocks, elongated, stick-type), however, a preferred structure for the crayon 14 is a writing stick structure having a tapered writing end and a rear blunt end opposite of the tapered writing end commonly utilized in coloring crayons 14 such as CRAYOLA® brand crayons 14 manufactured by Crayola LLC. There are two main sizes for crayons 14 which are 3⅝ inches long×5/16 inch diameter and 4 inches long×7/16 inch diameter.

C. Nozzle.

Figure 2:
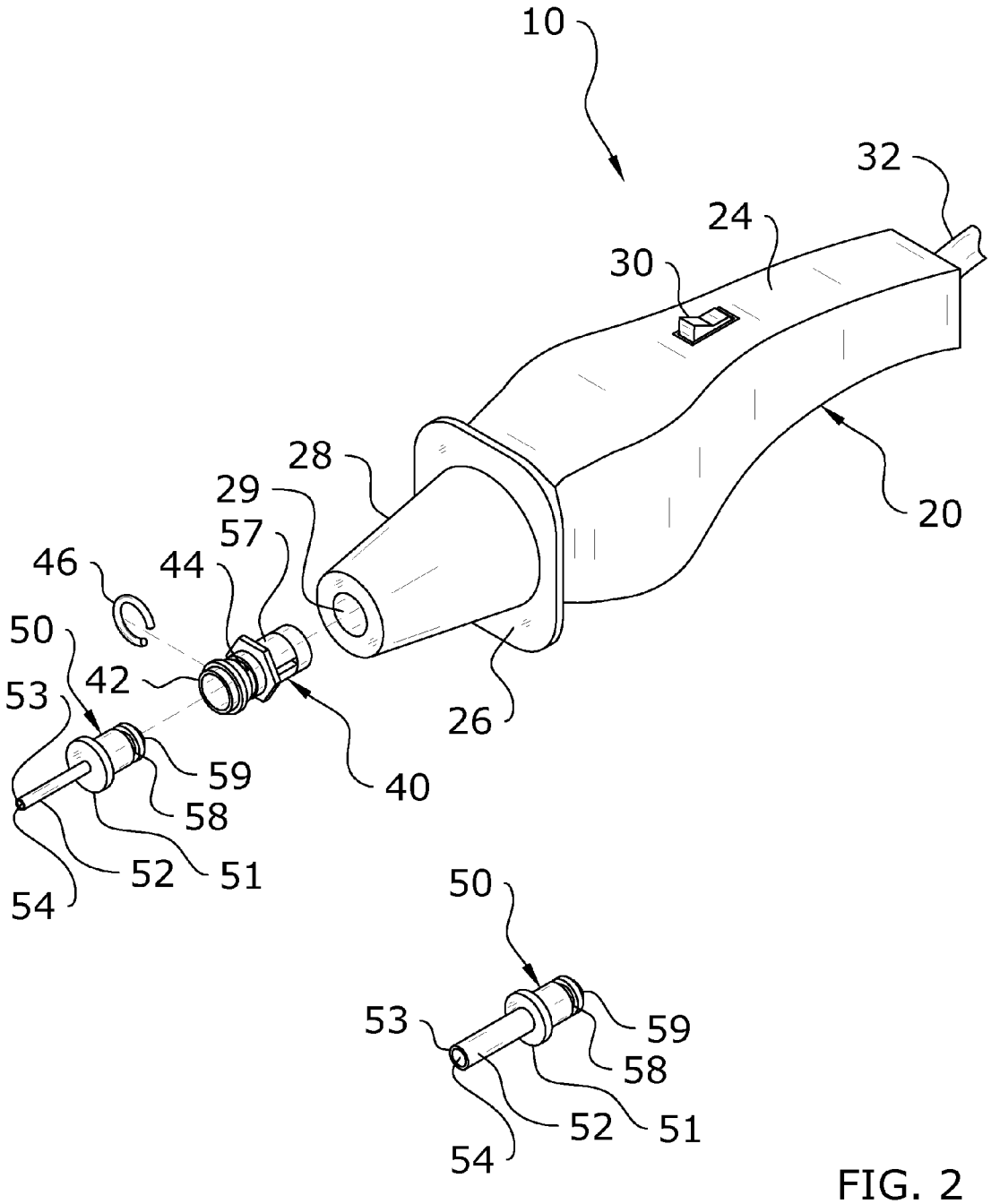
FIG. 2 is an exploded upper perspective view of the present invention with two different sizes of nozzles.
Figure 3:
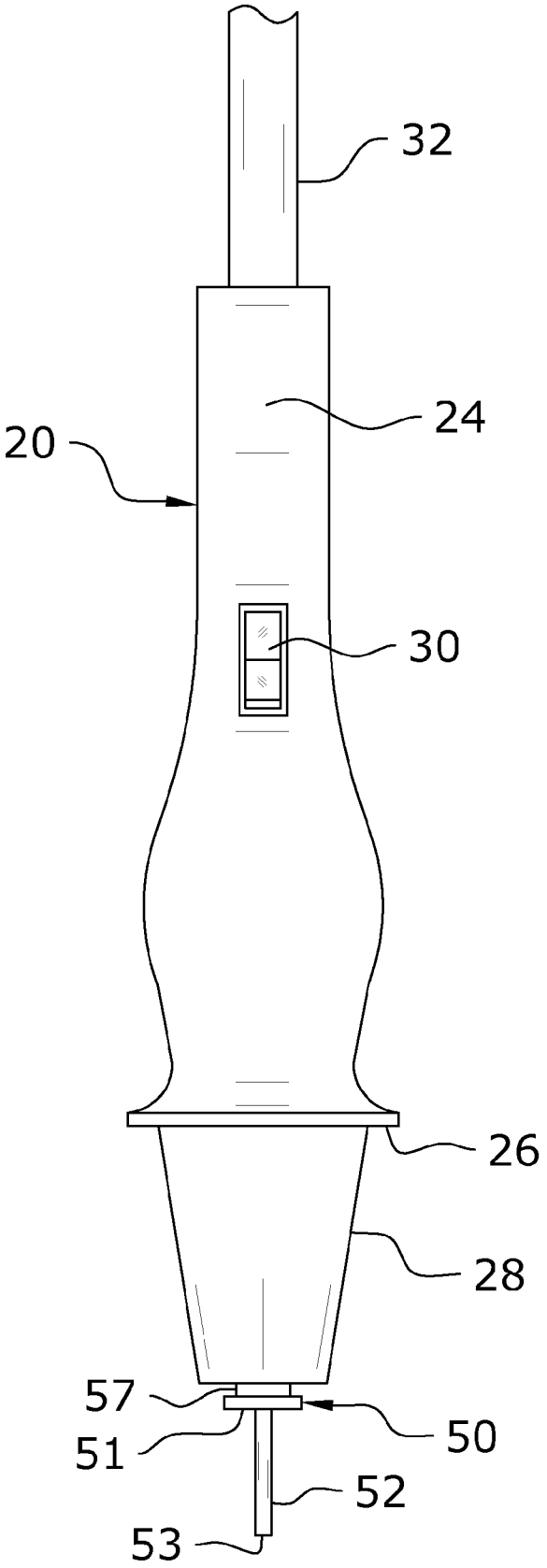
FIG. 3 is a top view of the present invention.
Figure 4:
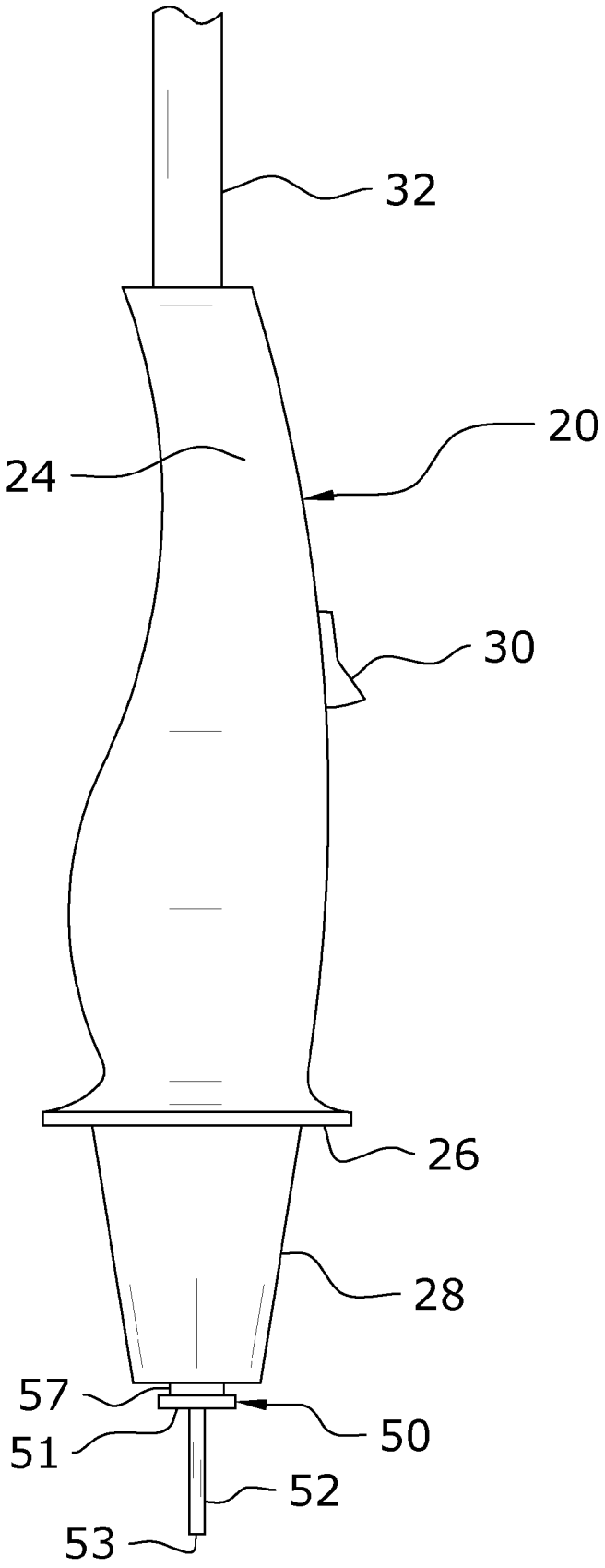
FIG. 4 is a side view of the present invention.
Figure 6:
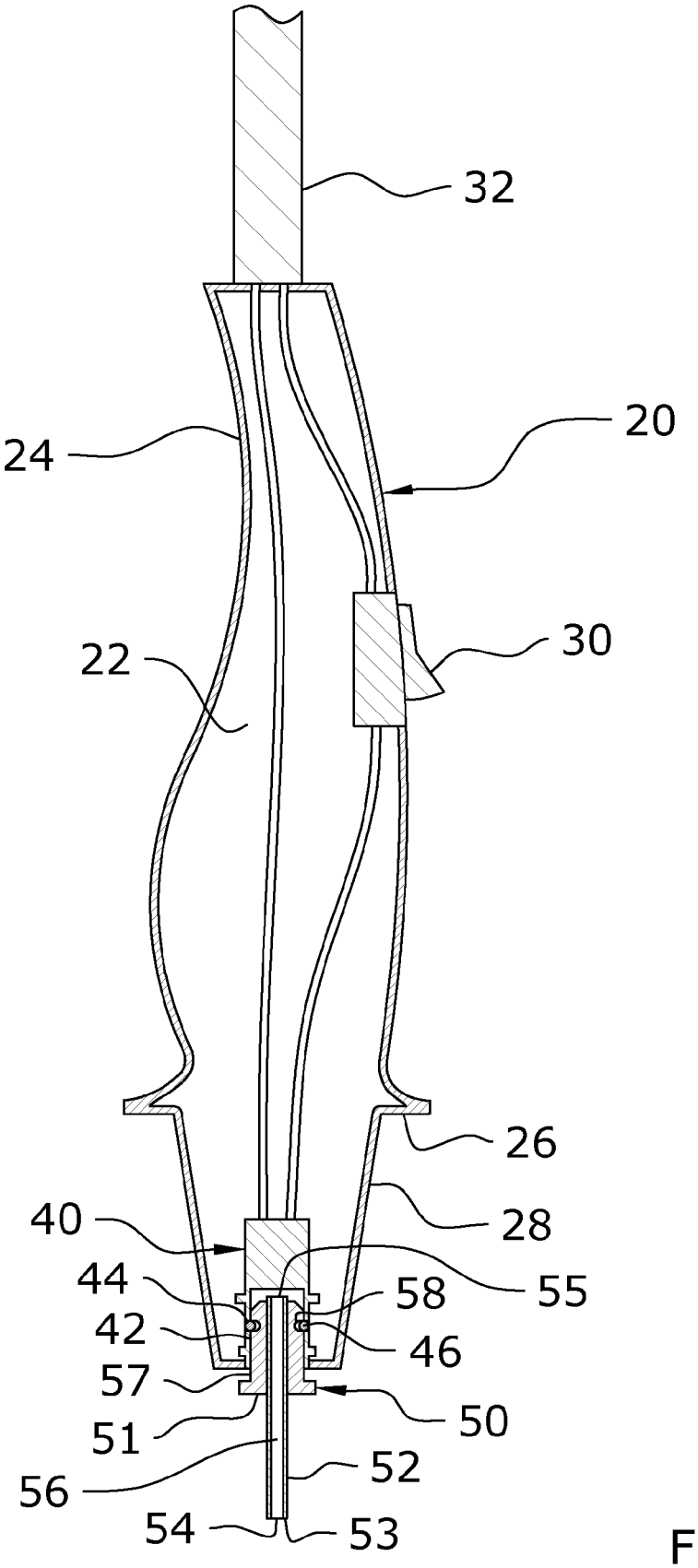
FIG. 6 is a cross sectional view taken along line 6-6 of FIG. 5.

The nozzle 50 is comprised of a support body 57 and a tube 52 extending outwardly from the support body 57 as illustrated in FIG. 2 of the drawings. The support body 57 of the nozzle 50 is formed for being removably received within the heater unit 40 to allow for the changing of the nozzle 50 for different sizes of tubes 52 (e.g. different length, different cross sectional shape, different sizes/widths/diameters, etc.). The support body 57 includes a flanged portion 51 that is positioned near the portion of the tube 52 extending outwardly from the support body 57. The support body 57 is preferably larger in size (e.g. larger diameter) than the tube 52 as illustrated in FIG. 6 of the drawings. The support body 57 further preferably includes a tapered end 59 opposite of the flanged portion 51 to guide the support body 57 into the receptacle 42 of the heater unit 40 and a channel 58 surrounding the perimeter of the support body 57 for catchably receiving a securing member 46 of the heater unit 40. The support body 57 is preferably cylindrical in shape and is comprised of a heat conductive material such as a heat conductive metal (preferably copper).

The tube 52 extends outwardly from the support body 57 to allow for insertion into a crayon 14 and for painting upon a painting surface 16 as illustrated in FIGS. 1 through 4 of the drawings. The tube 52 is in thermal communication with the support body 57 of the nozzle 50 to conduct heat from the support body 57 sufficiently to increase the temperature of the tube 52 to at least 120 degrees Fahrenheit or greater (i.e. to a temperature sufficient to melt crayon 14). The entire length of the tube 52 is preferably heated to a temperature sufficient to melt crayon 14.

The tube 52 preferably extends concentrically from the support body 57 and further preferably extends completely through the support body 57 wherein a vent opening 55 within an inner end of the tube 52 opposite of the receiver-dispenser opening 54 is positioned to allow for venting the lumen 56 of the tube 52. The support body 57 is preferably constructed of a solid metal that surrounds a portion of the tube 52 thereby efficiently transferring heat from the support body 57 to the tube 52. Venting of the lumen 56 of the tube 52 is required to allow for the melted crayon 14 to be inserted into the lumen 56 and to be discharged from the lumen 56. The vent opening 55 may be positioned in other locations along the tube 52 but is positioned a distance away from the receiver-dispenser opening 54 to allow for a desired volume of melted crayon 14 to enter. The inner end of the tube 52 preferably extends slightly outwardly from the support body 57 as further illustrated in FIG. 6 of the drawings.

The tube 52 is comprised of an elongated tubular structure includes a distal end 53, the receiver-dispenser opening 54 within the distal end 53 and the lumen 56 fluidly connected to the receiver-dispenser opening 54 as illustrated in FIGS. 2 and 6 of the drawings. The lumen 56 preferably extends the entire length of the tube 52 from the distal end 53 to the inner end fluidly connecting the receiver-dispenser opening 54 and the vent opening 55 as further illustrated in FIG. 6 of the drawings.

The tube 52 is constructed of a heat conductive material that has a high thermal conductivity and is further preferably constructed of a metal that is heat conductive (preferably copper). The tube 52 is preferably constructed of the same material as the support body 57. While the tube 52 is illustrates as being connected to the support body 57, the tube 52 may be integrally formed with the support body 57.

The tube 52 preferably has a length of at least 0.4 inches and further preferably has a length of at least 0.9 inches to provide a sufficient distance for the lumen 56 to receive a desired volume of melted crayon 14. The tube 52 preferably has a straight structure to provide easy insertion into and removal from the crayon 14.

Figure 5:
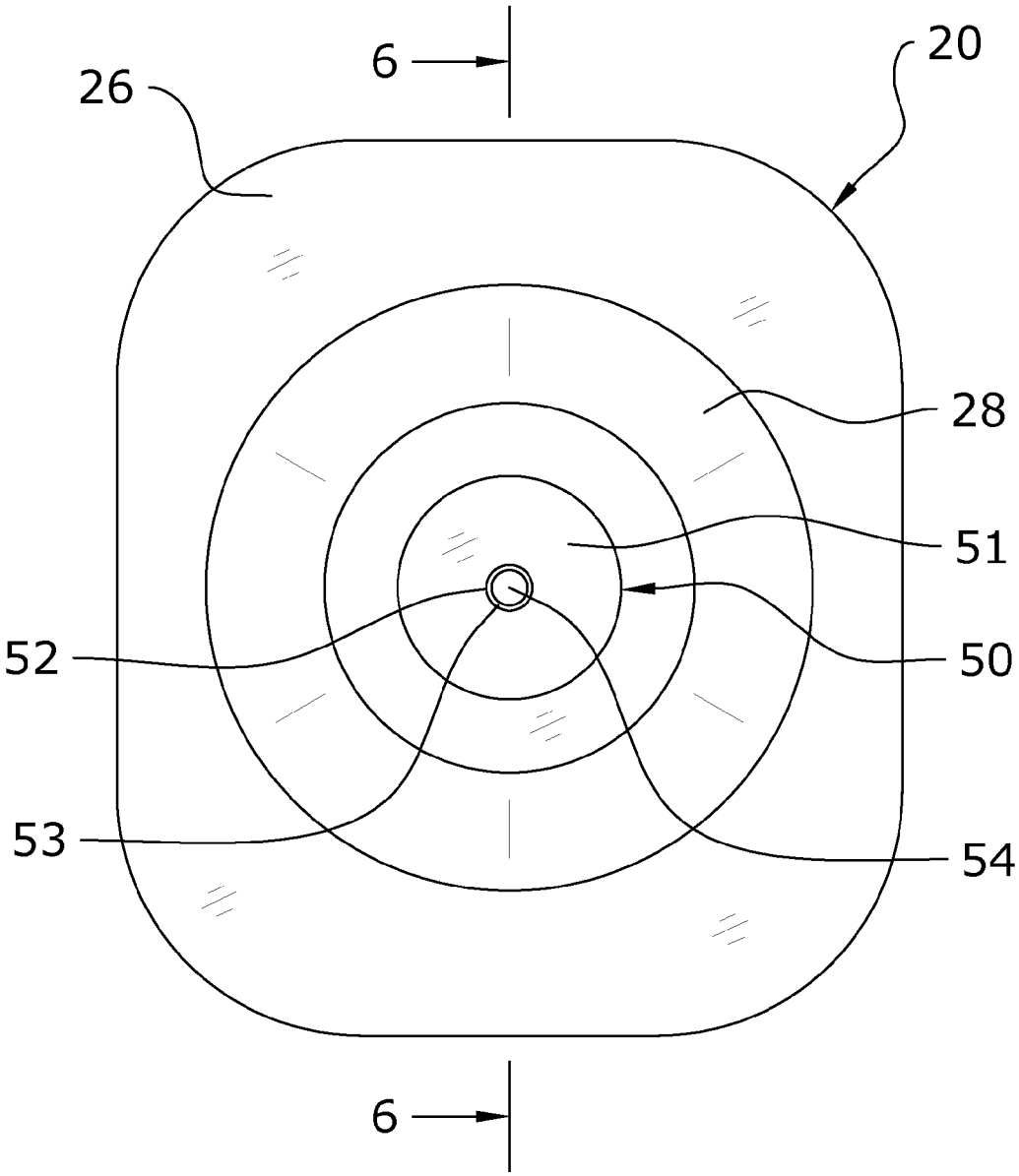
FIG. 5 is a front end view of the present invention.

The lumen 56 of the tube 52 preferably has a constant diameter through an entire length of the tube 52, however, the lumen 56 of the tube 52 may have a varying interior size along the length of the tube 52. The exterior surface of the tube 52 is preferably not tapered and more particularly is preferably a circular cross sectional shape along the length of the tube 52 as illustrated in FIG. 6 of the drawings. The tube 52 is preferably concentric with the longitudinal axis of the support body 57 as illustrated in FIG. 5. In addition, the distal end 53 of the tube 52 preferably has a flattened end having a plane that is transverse with respect to a longitudinal axis of the tube 52 as illustrated in FIG. 6 of the drawings.

The lumen 56 preferably has the same shape and size as the receiver-dispenser opening 54 to allow for a consistent flow inwardly and outwardly of the melted crayon 14. The lumen 56 preferably has an interior diameter of between 0.0625 inches to 0.125 inches and the receiver-dispenser opening 54 preferably has a diameter of between 0.0625 inches to 0.1250 inches. The exterior diameter of the tube 52 is preferably between 0.0775 inches to 0.1390 inches. The tube 52 further preferably has an outer wall having a thickness of between 0.014 inches to 0.027 inches thereby providing sufficient heating characteristics to melt the crayon 14 along the entire length of the tube 52 while providing a relatively thin profile to allow for little resistance when inserted into the crayon 14.

D. Heating Unit.

It is preferable that the heating unit used to heat the tube 52 be comprised of a heater unit 40 thermally connected to the nozzle 50 and/or tube 52. The heating unit may include various types of heating elements such as but not limited to an electrical heating element. One preferred type of heating element is a positive temperature coefficient (PTC) ceramic heating element.

The heater unit 40 is positioned within a housing 20 having an interior cavity 22 and more particularly is preferably positioned within a front opening 29 within a front portion 28 of the housing 20 opposite of a handle portion 24 as illustrated in FIGS. 1 through 6 of the drawings. A protective portion 26 extends outwardly around the body of the housing 20 to protect the user's hand from contacting the heater unit 40 and/or the nozzle 50 during usage as illustrated in FIGS. 1 through 5 of the drawings.

The heater unit 40 includes a receptacle 42 that removably receives the support body 57 of the nozzle 50. The receptacle 42 of the heater unit 40 is constructed of a thermally conductive material such as metal (e.g. copper) to efficiently transfer heat from the heater unit 40 to the tube 52. The receptacle 42 is formed and adapted to catchably receive the support body 57 and/or the tube 52 to allow for removing and changing nozzles 50 depending upon different painting applications or replacing a damaged nozzle 50. The receptacle 42 preferably is only slightly larger than the support body 57 of the nozzle 50 to provide a snug fit of the support body 57 within the receptacle 42 thereby maximizing the amount of surface contact between the interior surface of the receptacle 42 and the exterior surface of the support body 57. Alternatively, the tube 52 may be permanently connected to the heater unit 40 in a non-removable manner.

Various technologies may be utilized to catchably receive the nozzle 50 within the receptacle 42 such as at least one aperture 44 extending into the interior of the receptacle 42 with a securing member 46 (C-spring member) partially extending into the interior of the receptacle 42 to selectively and catchably be positioned within the channel 58 surrounding the support body 57 as illustrated in FIGS. 2 and 6 of the drawings.

Figure 8:
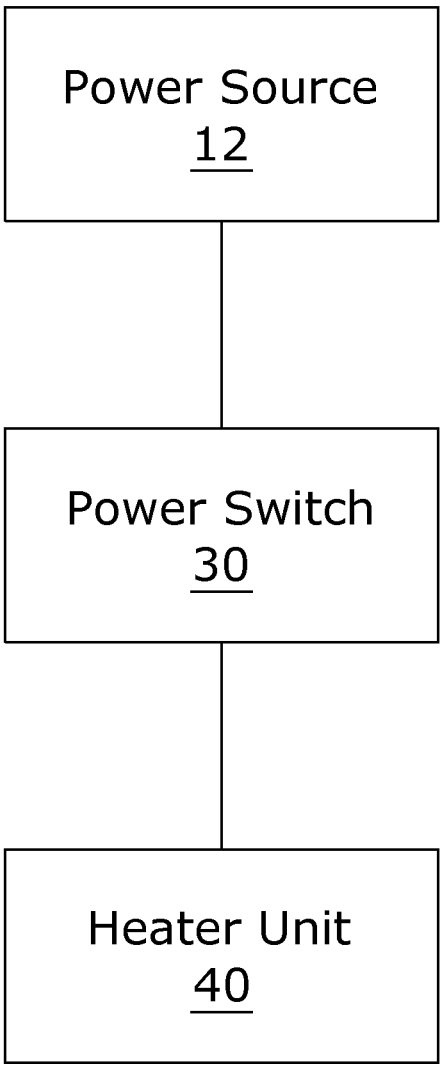
FIG. 8 is a block diagram illustrating the electrical components of the present invention.
Figure 9:
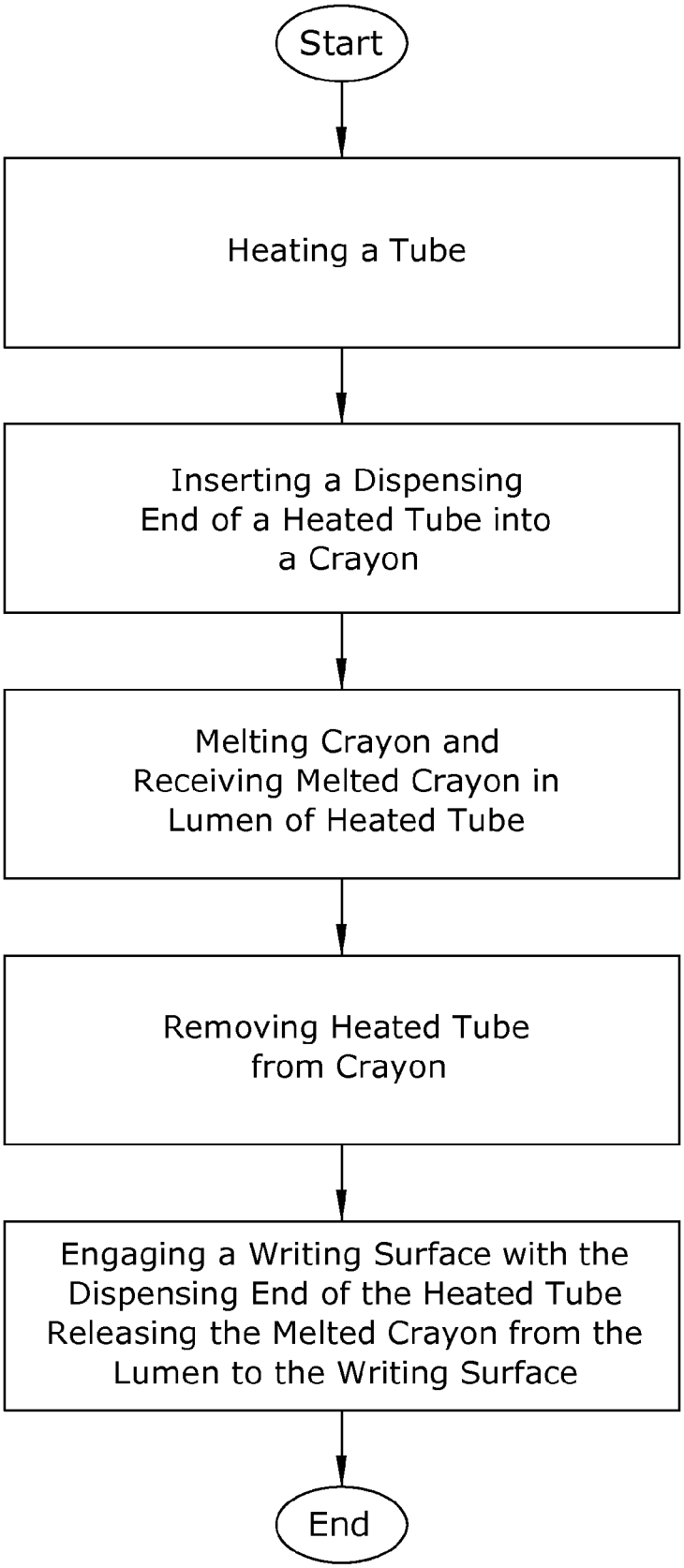
FIG. 9 is a flowchart illustrating the overall process for the present invention.

A power switch 30 is attached to the housing 20 and is electrically connected between a power source 12 (e.g. a power cord 32, a battery) and the heater unit 40 to selectively provide electrical power to the heater unit 40 as illustrated in FIG. 8 of the drawings. The power switch 30 may be comprised of a toggle switch having an ON or OFF state for the user to manipulate as further shown in FIGS. 1 through 4 of the drawings.

E. Operation of Preferred Embodiment.

FIGS. 7*a* through 7*e* and 9 illustrate the usage of the preferred embodiment of the present invention. The user first selects the size (e.g. length, interior diameter) of tube 52 desired for the particular portion of the melted crayon art they are creating. Some portions of the melted crayon art may require a larger diameter tube 52 and other portions may require a smaller diameter for more detailed painting with the melted crayon 14. Once the user selects the desired size of tube 52, the user inserts the nozzle 50 containing the tube 52 into the heater unit 40. The user then selects the color of crayon 14 to be used for the painting and selects the appropriately colored crayon 14.

The tube 52 is then heated to a temperature sufficient to melt conventional wax crayon 14. Hence, the tube 52 must be heated to a temperature at least equal to the melting point of conventional wax crayons 14 (e.g. at least 120 degrees Fahrenheit).

Figure 7A:
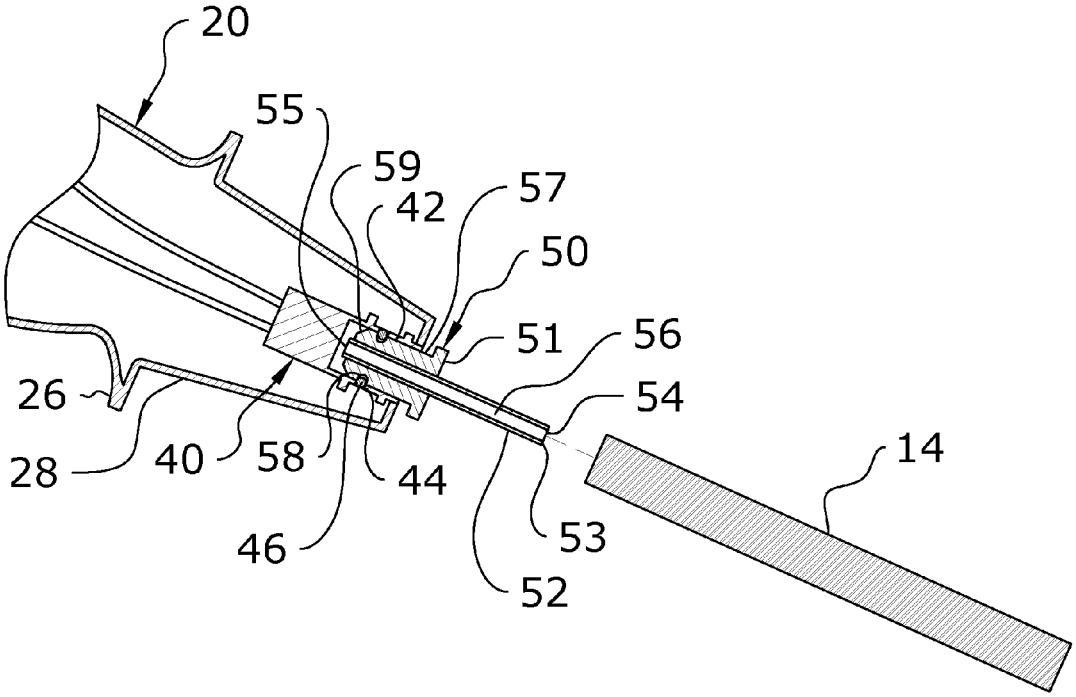
FIG. 7*a* is a side cutaway view of the present invention with a heated tube of the nozzle aligned with an end of a crayon.
Figure 7B:
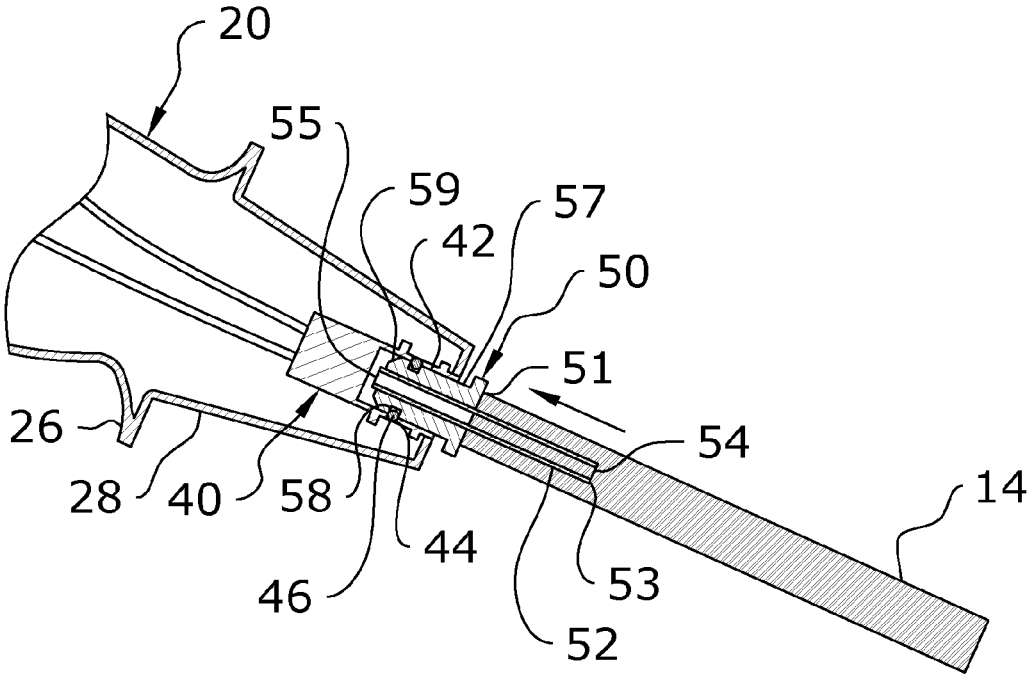
FIG. 7*b* is a side cutaway view of the heated tube inserted into the end of the crayon with melted crayon positioned within the lumen of the heated tube.

After the tube 52 is heated to a temperature sufficient to melt conventional wax crayon 14, the user then aligns the tube 52 with the portion of the crayon 14 intended to be inserted into as illustrated in FIG. 7*a* of the drawings. For longer tubes 52 the user preferably inserts the tube 52 into one of the ends of the crayon 14 if the crayon 14 is comprised of a stick type of structure to ensure the maximum amount of melted crayon 14 is inserted into the lumen 56 of the tube 52. The user then inserts the distal end 53 of the tube 52 into a crayon 14 thereby melting a portion of the crayon 14 with the tube 52 as illustrated in FIG. 7*b* of the drawings. The distal end 53 of the tube 52 may be inserted at least 0.25 inches into the crayon 14 or more depending upon the length of tube 52 used and the amount of melted crayon 14 desired within the tube 52. As the portion contacted by the tube 52 of the crayon 14 is melted, a volume of melted crayon 14 from the crayon 14 is received into the lumen 56 from the receiver-dispenser opening 54 as further shown in FIG. 7*b* of the drawings. As the user initially inserts the distal end 53 into the crayon 14, the tube 52 melts the crayon 14 with a portion being melted externally of the tube 52 and with a portion being melted at the end that flows into the lumen 56 through the receiver-dispenser opening 54 within the tube 52. As the user continues to insert the tube 52 into the crayon 14, a portion of the melted crayon 14 is inserted into the lumen 56 approximately the same length as the length of the tube 52 inserted into the crayon 14 as further illustrated in FIG. 7*b* of the drawings. It should be noted that the melted crayon 14 is not inserted into the lumen 56 via the vent opening 55 and instead the melted crayon 14 is only inserted into the lumen 56 via the receiver-dispenser opening 54.

Figure 7C:
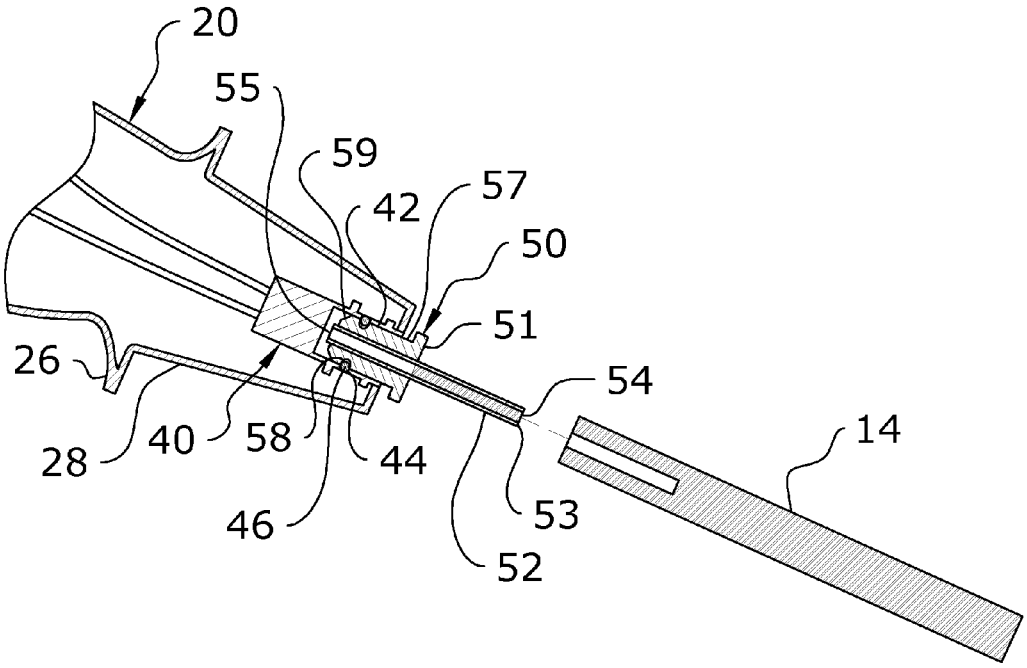
FIG. 7*c* is a side cutaway view of the heated tube removed from the end of the crayon.
Figure 7D:
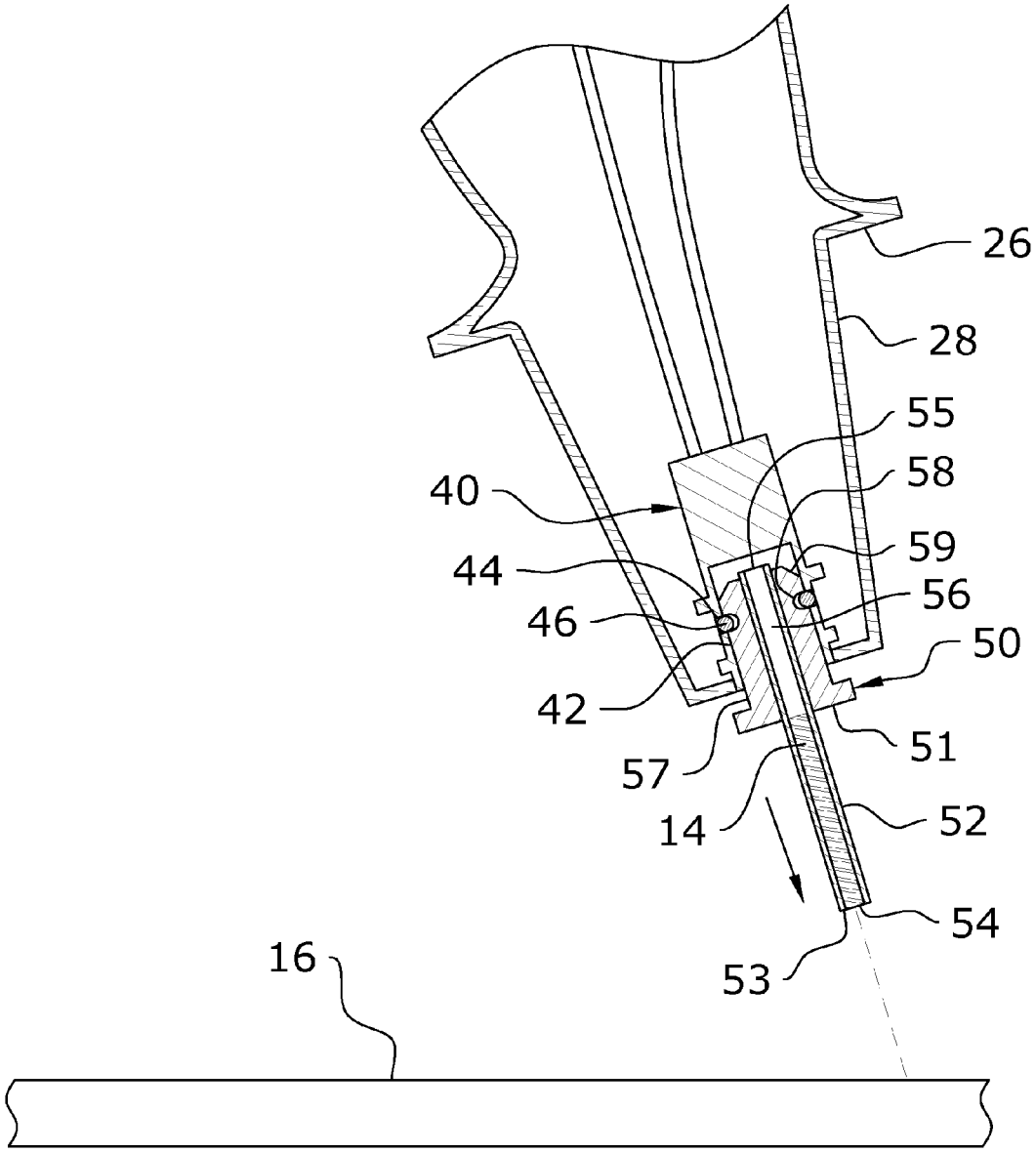
FIG. 7*d* is a side cutaway view of the heated tube positioned above a painting surface.
Figure 7E:
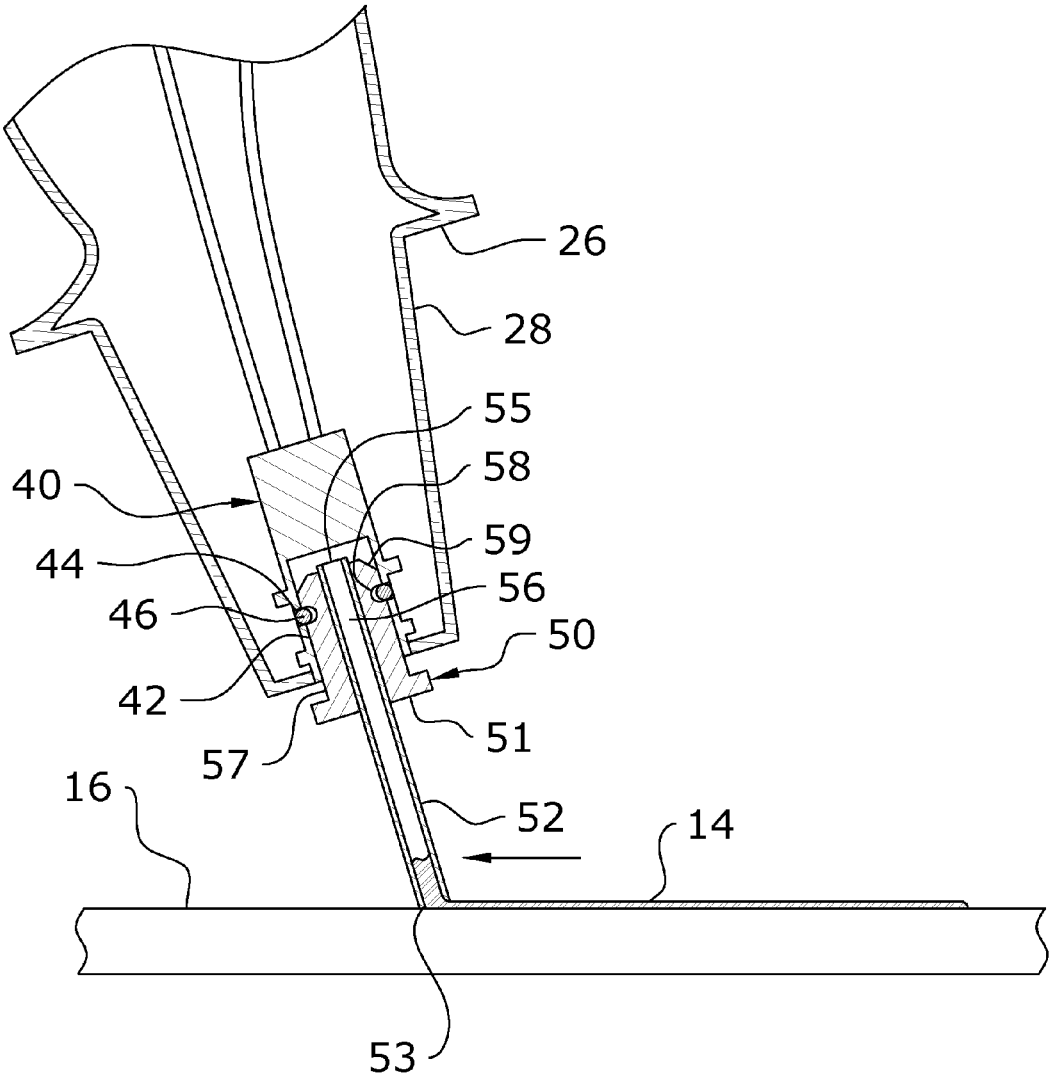
FIG. 7*e* is a side cutaway view of the heated tube engaging the painting surface and dispensing the melted crayon.

After a desired amount of melted crayon 14 is received within the tube 52, the user then removes the distal end 53 of the tube 52 from the crayon 14 leaving an elongated cavity within the crayon 14 and a portion of the melted crayon 14 remaining within the lumen 56 of the tube 52 as illustrated in FIG. 7*c* of the drawings. The user then identifies the location upon the painting surface 16 desired to be painted with the melted crayon 14 and then positions the distal end 53 of the tube 52 near or in contact with the same as illustrated in FIG. 7*e*. A portion of the distal end 53 of the tube 52 preferably engages upon the painting surface 16 with a remaining portion not contacting the painting surface 16 as illustrated in FIG. 7*e*. The tube 52 is preferably positioned at an angle with respect to the painting surface 16 during painting with the melted wax, however, the tube 52 may be transverse or parallel with respect to the painting surface 16.

The volume of melted crayon 14 within the lumen 56 is then discharged from the receiver-dispenser opening 54 via gravity with the vent opening 55 allowing the entry of air into the lumen 56 behind the melted crayon 14 that is being dispensed as shown in FIG. 7*e* of the drawings. The user moves the tube 52 and more particularly the distal end 53 of the tube 52 in a desired manner to create the desired visual effect of the painting with the melted crayon 14 upon the painting surface 16. The user may lift the distal end 53 from one location of the painting surface 16 and continue painting in another location. Once the melted crayon 14 is fully dispensed from the tube 52, the user refills the tube 52 by repeating the above procedure of inserting the tube 52 into the crayon 14 in a different location.

If the user desires to change the color of crayon 14 used for the painting of the melted crayon art, the user ensures that the melted crayon 14 is removed from the lumen 56 of the tube 52 and wipes off any remaining melted crayon 14 on the exterior of the tube 52 with a rag. The user can then insert the tube 52 into the second colored crayon 14 and repeat the above process to apply the second color of crayon 14 upon the painting surface 16. This process continues for as many colors of crayon 14 as the user desires.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method of creating melted crayon art, comprising:

providing a tube having a distal end, a receiver-dispenser opening within said distal end and a lumen fluidly connected to said receiver-dispenser opening;

heating said tube to a temperature of at least 120 degrees Fahrenheit;

inserting said distal end of said tube into a crayon;

melting a portion of said crayon with said tube;

receiving a volume of melted crayon from said crayon into said lumen from said receiver-dispenser opening;

removing said distal end of said tube from said crayon; and dispensing said volume of melted crayon within said lumen from said receiver-dispenser opening.

2. The method of claim 1, wherein said tube is comprised of a heat conductive material.

3. The method of claim 2, wherein said tube is comprised of metal.

4. The method of claim 3, wherein said tube is comprised of copper.

5. The method of claim 1, wherein said tube is comprised of a linear elongated tubular structure.

6. The method of claim 1, wherein said tube has a length of at least 0.4 inches.

7. The method of claim 6, wherein said tube has a length of at least 0.9 inches.

8. The method of claim 1, wherein said lumen of said tube has a constant diameter through an entire length of said tube.

9. The method of claim 1, wherein said tube includes a vent opening, wherein said vent opening is positioned away from said distal end of said tube.

10. The method of claim 1, wherein said tube is comprised of a circular cross sectional shape and wherein an exterior surface of said tube is not tapered.

11. The method of claim 1, wherein said distal end is transverse with respect to a longitudinal axis of said tube.

12. The method of claim 1, wherein said lumen has a cross sectional shape that is the same in shape and in size as said receiver-dispenser opening.

13. The method of claim 1, wherein said lumen has an interior diameter of between 0.0625 inches to 0.125 inches.

14. The method of claim 1, wherein said receiver-dispenser opening has a diameter of between 0.0625 inches to 0.1250 inches.

15. The method of claim 1, wherein an exterior diameter of said tube is between 0.0775 inches to 0.1390 inches.

16. The method of claim 1, wherein said tube has an outer wall having a thickness of between 0.014 inches to 0.027 inches.

17. The method of claim 1, wherein said step of dispensing is comprised of engaging said distal end of said tube upon a painting surface, wherein said tube is positioned at an angle with respect to said painting surface.

18. The method of claim 1, wherein a heater unit is thermally connected to said tube.

19. The method of claim 1, wherein said step of inserting said distal end of said tube into a crayon is comprised of inserting said distal end of said tube into an end of said crayon.

20. The method of claim 1, wherein said step of inserting said distal end of said tube into a crayon is comprised of inserting said distal end of said tube at least 0.25 inches into said crayon.

* * * * *